United States Patent [19]

Kageyama et al.

[11] 4,165,941

[45] Aug. 28, 1979

[54] MECHANICAL PENCIL

[75] Inventors: Hidehei Kageyama; Takahiko Suzuki, both of Kawagoe, Japan

[73] Assignee: Kotobuki & Co. Ltd., Kyoto, Japan

[21] Appl. No.: 813,340

[22] Filed: Jul. 6, 1977

[30] Foreign Application Priority Data

Jul. 10, 1976 [JP] Japan ..... 51-91945[U]
Oct. 8, 1976 [JP] Japan ..... 51-135662[U]

[51] Int. Cl.[2] ..... B43K 27/00
[52] U.S. Cl. ..... 401/31; 401/67
[58] Field of Search ..... 401/67, 62, 19, 30, 401/31, 82–84, 104, 112–114

[56] References Cited

U.S. PATENT DOCUMENTS

| | | | |
|---|---|---|---|
| 268,355 | 11/1882 | Boman | 401/62 |
| 1,549,264 | 8/1925 | Nealon | 401/29 |
| 1,585,843 | 5/1926 | Fitch | 401/62 |
| 3,604,816 | 9/1971 | Levoin | 401/31 |
| 3,724,960 | 4/1973 | Hashimoto et al. | 401/67 |
| 3,765,781 | 10/1973 | Hashimoto et al. | 401/67 |
| 3,814,524 | 6/1974 | Sperti | 401/67 X |
| 3,865,496 | 2/1975 | Robbins | 401/31 X |
| 3,914,059 | 10/1975 | Mitsuya | 401/67 |

*Primary Examiner*—Clifford D. Crowder
*Attorney, Agent, or Firm*—Sherman & Shalloway

[57] ABSTRACT

A writing instrument includes a holding outer tube to be held by the user and a lead rod holding means, said lead rod holding means being provided in said holding outer tube and movable relative to said outer tube. The writing instrument has a lead rod feeding means; an engaging member for holding said lead rod holding mechanism at a position where a lead rod guiding pipe engages with an engaging surface formed on said holding outer tube when said lead rod guiding pipe advances to a position projected from said holding outer tube by pressing said lead rod holding means; and a push button provided for pushing said engaging member to release the engagement with said surface.

15 Claims, 8 Drawing Figures

MECHANICAL PENCIL

BACKGROUND OF THE INVENTION

1. Field of the Invention

This invention relates to a writing instrument, and more particularly to a provision of a writing instrument, in which there is provided a means movable in the axial direction relative to a holder, said means functioning to hold a lead rod at a predetermined position and to advance it when necessary. and thereby extending it from the forward end of the writing instrument. More specifically, this invention is to provide a writing instrument wherein, when the writing instrument is used, the tip end of the lead rod holding means is held at a positioned projected from the forward end of the holder, while when it is not used, it is held in the holder.

2. Description of the Prior Art

In the conventional writing instruments of this type, especially in automatic pencils, the user has to stop writing and extend the lead in a length as required when it is worn away. Further, there has been proposed a method of preventing the lead from being broken or a method of preventing the lead from damaging a pocket of clothes or the like by enclosing the lead in the holder when it is not used, but there has been a risk of other objects being damaged by the tip end of the lead rod holding mechanism, that is, a thin pipe for guiding a lead rod projected when carried by the user. Furthermore, since the lead rod guiding pipe is made thin corresponding to the diameter of the lead rod to be inserted, there has been a disadvantage such that the lead rod guiding pipe itself damages other objects.

SUMMARY OF THE INVENTION

Therefore, it is an object of the present invention to obviate the above described defects in the prior art and to provide a simple writing instrument.

Another object of this invention is to provide a writing instrument having a function wherein, in the course of writing, the lead is held at a predetermined position and it is extended when necessary.

A further object of the present invention is to provide a writing instrument wherein, when the writing instrument is not used, the lead rod as well as the thin pipe for guiding a lead rod are enclosed in the holder whereby there is no risk of the guiding pipe damaging the other objects nor the guiding pipe itself being damaged by the other objects.

A still further object of the present invention is to provide a writing instrument having a structure wherein a plurality of lead rods are selectively projected through the respective guide pipes.

The other objects and features of the present invention will be more apparent from the following description referring to the accompanying drawings.

PREFERRED EMBODIMENTS OF THE INVENTION

Figure 1:
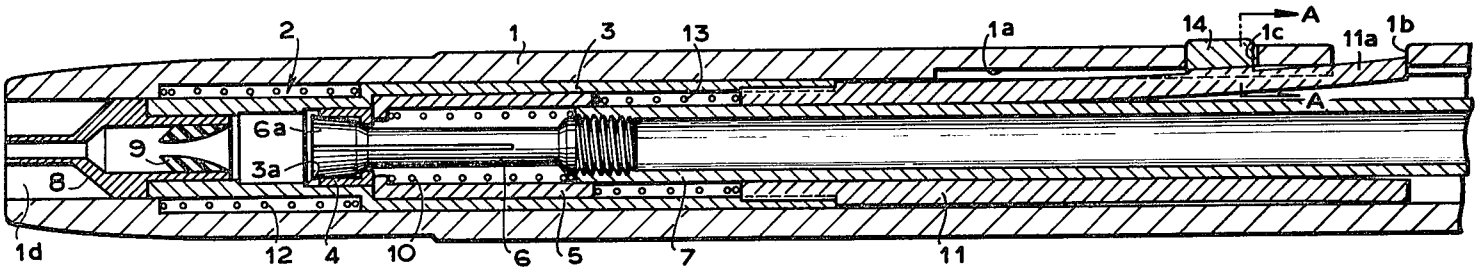
FIG. 1 is a longitudinal sectional view of a principal part of the first embodiment of an automatic pencil according to the present invention, in which a lead rod is not shown.

Embodiments of the present invention will now be described in detail referring to the accompanying drawings. In FIG. 1, reference numeral 1 denotes a tubular holder and 2 a lead rod holding mechanism inserted in said holder 1 and movable in the axial direction. The lead rod holding mechanism 2 comprises an inner tube 3 movable in the axial direction relative to the holder 1, a ring 4 and sleeve 5 movable in the axial direction relative to the inner tube 3 for retaining the ring 4 in forward position, a chucking tube 6 movable in the axial direction relative to the inner tube 3, the ring 4 and the sleeve 5, respectively, and a lead rod case 7 integrally coupled with the chucking tube 6. The lead rod (not shown) is housed in the lead rod holding mechanism 2 so as to pass through the central hole of the chucking tube 6 from the lead rod case 7 and to be extended outward through the central hole of a cap 8 provided at the forward end of the inner tube for holding the lead rod. Reference numeral 9 represents friction members mounted in the cap 8 for imparting suitable friction to the lead rod when it is moved.

In a state that any load is not imparted to each of said parts, the chucking tube 6 is urged in the retracted direction relative to the sleeve 5 by the action of a spring 10. In this state, the ring 4 abutting against the sleeve 5 at the forward end is adapted to clamp the chucking portion 6*a* of the chucking tube 6 from the outside thereof, and thereby securely fixing the lead rod with respect to the chucking tube 6. Further, with the rear end of the inner tube 3 is integrally coupled an engaging member 11 movable in the axial direction relative to the holder 1 and the lead rod case 7. A lip 11*a* formed on the engaging member 11 enters into a groove 1*a* formed on the inner surface of the holder 1 and pressedly abuts against the bottom surface of the groove 1*a* by its own elasticity.

In a state that the writing instrument is not used as shown in FIG. 1, the whole of lead rod holding mechanism 2 is held at the most retracted position relative to the holder 1, in which the forward end of the lip 11*a* abuts against the engaging surface 1*b* formed on the holder 1. When the rear end (where a cap is, in general, mounted) of the lead rod case 7 projecting from the rear end of the holder 1 is pushed, the pressing force is transmitted to the inner tube 3 through the spring 10 and sleeve 5, whereby the lead rod holding mechanism 2 moves forward while compressing the spring 12 and the forward movement causes the cap 8 to project through an opening 1*d* formed on the forward end of the holder 1. Further, when the lead rod case 7 is released in a state that the rear end of the lip 11*a* passes over the second engaging surface 1*c* formed on the holder 1, the lead rod holding mechanism 2 is retreated until the lip 11*a* abuts against the engaging surface 1*c* by the action of the spring 12, and held thereat. Thus, the forward end of the cap 8 is projected from the forward end of the holder 1 by a predetermined length.

In this state, the further forward movement of the lead rod case 7 causes the inner tube 3 to move forward further relative to the holder 1, but after the inner tube 3 reaches the foremost end of its possible stroke, the lead rod case 7 and the chucking tube 6 move forward together with the lead rod 7 compressing the spring 10. The ring 4, clamped on the chucking portion 6*a*, is carried forward with the chucking tube 6. After the forward end of the ring 4 abuts against the abutting portion 3*a* formed on the inner surface of the inner tube 3, the clamping of the chucking portion 6*a* is released, whereby the lead rod is unclamped and held in the side of cap 8. Subsequent to this release, when the lead rod case 7 is released, it is retreated together with the chucking tube 6 by the action of the spring 10 and the lead rod is clamped by the chucking tube 6 which is again coupled with the ring 4 at the farthest retreated stage. Repetition of this operation causes the lead rod to extend at a required length. Incidentally, a spring 13 which acts in the direction of causing the sleeve 5 to move forward relative to the inner tube 3, serves as a cushion by allowing retraction of the lead rod together with the chucking tube 6, ring 4 and sleeve 5 when a large pressing force is imparted to the lead rod while being used.

Figure 2:
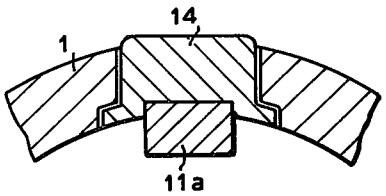
FIG. 2 is an enlarged sectional view along a line A—A in FIG. 1.
Figure 7:
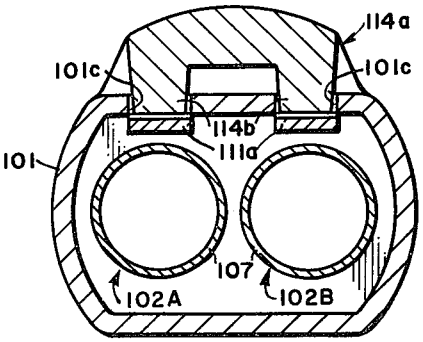
FIG. 7 is an enlarged sectional view of the embodiment shown in FIG. 4.

Further, the holder 1 is provided with a push button 14 at a position where the push button 14 makes contact with the lip 11*a* in engagement with the engaging surface 1*c*. The push button 14 is, as detailedly shown in FIG. 2, normally urged outward by the elasticity of the lip 11*a*. When the push button 14 is operated by pushing it inward with a finger tip or the like, the lip 11*a* is also pressed inward, whereby the lip 11*a* is released from the engagement with the engaging portion 1*c* and the lead rod holding mechanism 2 is retracted relative to the holder 1 by the action of the spring 12.

Figure 3:
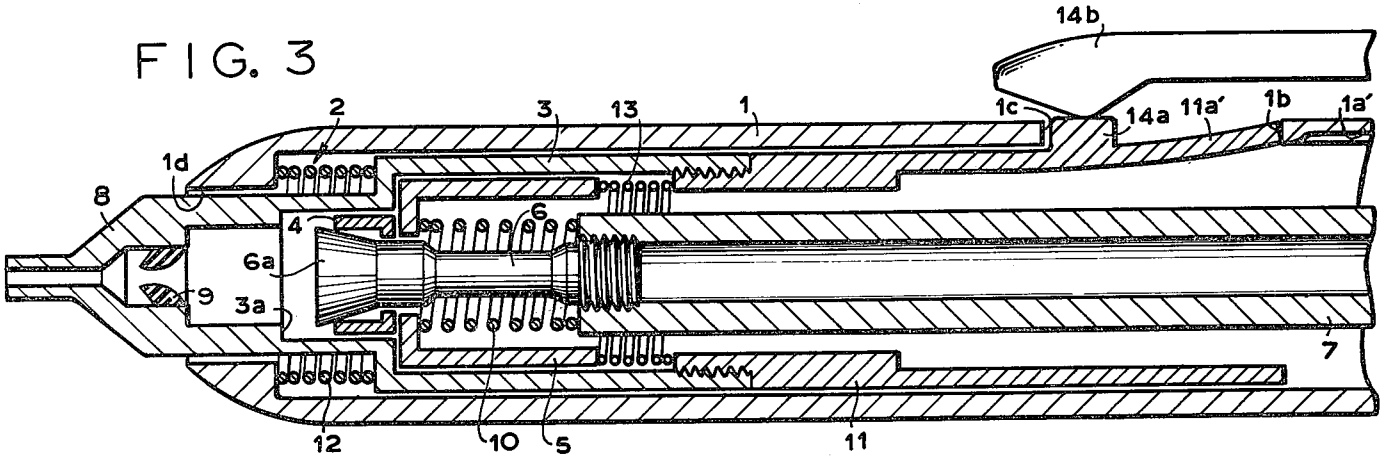
FIG. 3 is a longitudinal sectional view of a principal of the second embodiment.

FIG. 3 shows a modified embodiment of the writing instrument shown in FIG. 1 wherein like references depict like parts of FIG. 1. In FIG. 3 there is shown the state that the writing instrument is capable of being used as it is, that is, the cap 8 is extruded from the opening 1*d* at the top of the holder 1. In this state, the depression of an extrusion 14*a* integral with a lip 11*a'* causes the top of the lip 11*a'* to be disengaged from the engaging portion 1*b* of the holder 1 so that the lead rod holding mechanism 2 is retracted relative to the holder 1 by the action of the spring 12 and thereby the cap 8 is enclosed into the holder 1. Reference numeral 1*a'* illustrates a thin wall for easily guiding and sliding the lip 11*a'* rearward. The extrusion 14*a* may be pushed by means of a clip 14*b* replacing operator's finger upon occasion.

Figure 4:
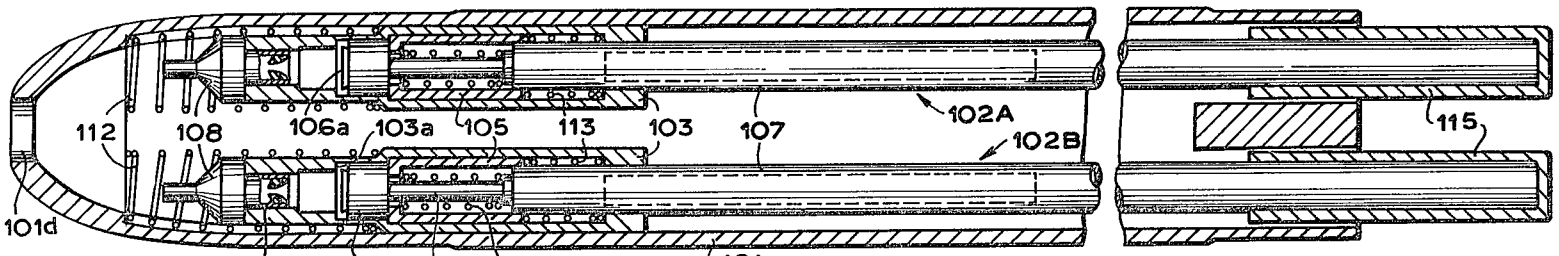
FIG. 4 is a longitudinal plan view of the third embodiment of an automatic pencil according to the present invention.
Figure 5:
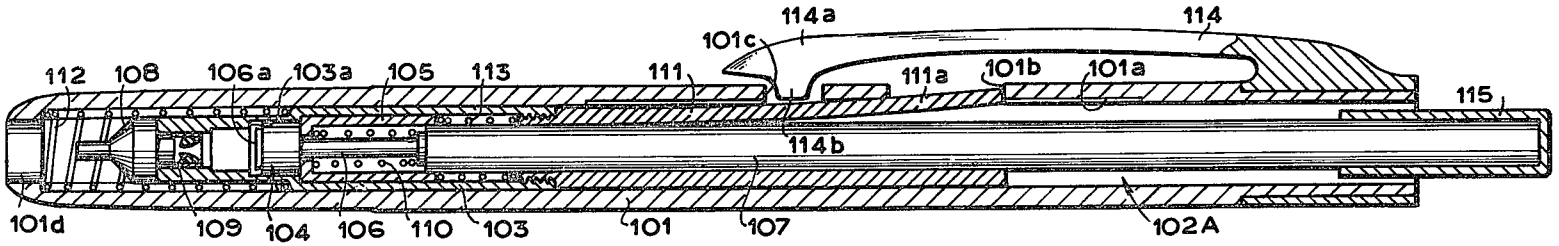
FIG. 5 is a sectional view of FIG. 4.
Figure 6:
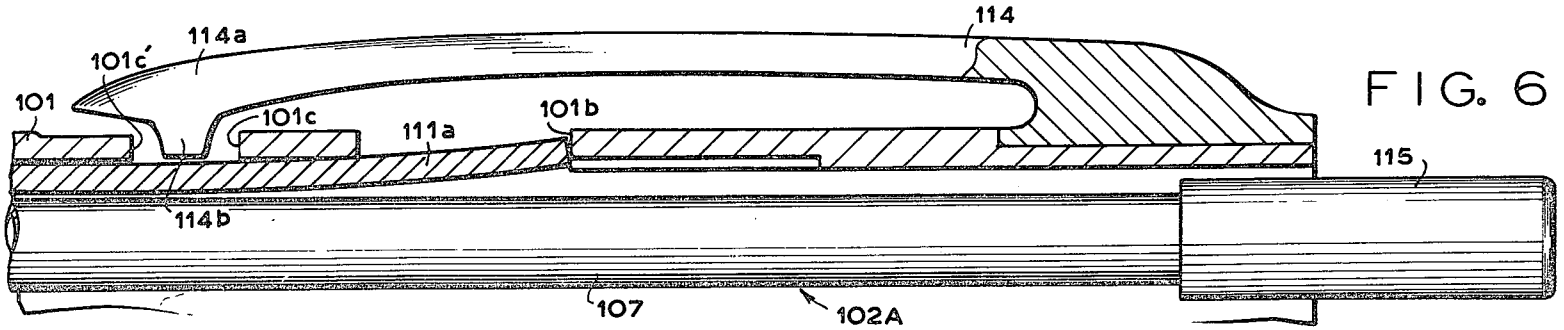
FIG. 6 is a longitudinal side view of the embodiment shown in FIG. 4.

FIGS. 4 through 7 show another embodiment of the present invention. Especially, FIGS. 4 and 5 show a state that the writing instrument is not used, in which reference numeral 101 designates a tubular holder formed in a flat shape, and 102A and 102B a pair of lead rod holding mechanisms which are inserted in the holder 101 and movable in the axial direction thereof. A lead rod holding mechanism 102A comprises an inner tube 103 movable in the axial direction relative to the holder 101, a ring 104 and sleeve 105 movable in the axial direction relative to the inner tube 103, a chucking tube 106 movable in the axial direction relative to the inner tube 103, ring 104 and sleeve 105, respectively, and a lead rod case 107 integrally coupled with the chucking tube 106.

The lead rod is received in the lead rod holding mechanism so as to pass through the central bore of the chucking cylinder 106 from the lead rod case 107 and to be projected outward through the friction members mounted in the cap 108 for imparting suitable friction to the lead rod when it is moved.

In a state that load is not imparted to each of said parts, the chucking tube 106 is urged in the retracting direction relative to the sleeve 105 by the action of the spring 110. In this state, the ring 104 abutting against the sleeve 105 at the forward end is adapted to clamp the chucking portion 106*a* of the chucking tube 106 from the outside and thereby securely fixing the lead rod to the chucking cylinder 106.

Further, with the rear end of the inner tube 103 is integrally coupled an engaging member 111 movable in the axial direction relative to the holder 101 and lead rod case 107. A lip 111*a* formed on the engaging member 111 projects into a groove 101*a* formed on the inner surface of the holder 101 and abuts against the bottom surface of the groove 101*a* by its own elasticity.

In a state that the writing instrument is not used as shown in FIGS. 4 and 5, the whole of lead rod holding mechanism 102*a* is held at the most retreated position with respect to the holder 101, in which the forward end of the lip 111*a* abuts against an engaging surface 101*b* formed on the holder 101. In this state, when the rear end (where a cap 115 is, in general, mounted) of the lead rod case 107 projecting from the rear end of the holder 101 is pushed, the pressing force is transmitted to the inner tube 103 through the spring 110 and sleeve 105, whereby the lead rod holding mechanism 102A moves forward while compressing the spring 112 and this forward movement causes the cap 108 to project through an opening 101*d* formed on the tip end of the holder 101. Further, when the lead rod case 107 is released in a state that the rear end of the lip 111*a* passes over the second engaging surface 101*c* formed on the holder 101, the lead rod holding mechanism 102A is retreated until the lip 111*a* abuts against the engaging surface 111*c* by the action of the spring 112, and held thereat. Thus, the forward end of the cap 108 is projected from the forward end of the holder 101 by a predetermined length.

In this state, the further forward movement of the lead rod case 107 causes the inner tube 103 to further move forward relative to the holder 101, but after the inner tube 103 reaches the foremost end of its movable stroke, the lead rod case 107 and the chucking tube 106 move forward together with the lead rod with compressing the spring 110. After the forward end of the spring 104 abuts against the abutting surface 103*a* formed on the inner surface of the inner tube 103, the clamping at the chucking portion 106*a* is releasd, whereby the lead is held in the side of cap 108. Subsequently to this release, when the lead rod case 107 is released, it is retreated together with the chucking tube 106 by the action of the spring 110 and the lead rod is clamped by the chucking tube 106 again coupled with the spring 104 at the farthest retreated stage. Repetition of this operation causes the lead rod to extend by a required length. Incidentally, a spring 113 which acts in the direction of causing the sleeve 105 to move forward relative to the inner tube 103, serves as a cushion by allowing retraction of the lead rod together with the chucking tube 106, spring 104 and the sleeve 105 when a large pressing force is imparted to the lead during writing.

Further, the holder 101 is provided with an opening defined by 101*c* and 101*c'* through which projection 114*b* makes contact with the lip 111*a* whenever the lip 111*a* is not in engagement with the engaing surface 101*b*.

On the other hand, at the rear end of the holder 101 is securely fitted a clip 114 of which forward end 114*a* is faced with the opening 101*c*. The forward end 114*a* is provided with a pair of projections 114*b*, 114*b* at the lower surface thereof for pressing a pair of lips 111*a*.

When the forward end 114*a* of the clip 114, as shown in FIG. 5, is pushed inward by means of finger tip or the like, the lip 111*a* is also pressed inward, whereby the lip 111*a* released from the engaging surface 101*c* and the lead rod holding mechanism 102A retracts relative to the holder 101 by the action of the spring 112.

Since another lead rod holding mechanism 102B is same in its construction and mechanism for making the advancing and retracting movements as those of the aforementioned mechanism 102A, the detailed description for same will be omitted.

In the above embodiment, the projections at the forward end of the clip and the openings of the holder corresponding therewith may be of any shape as far as their functions are not impaired. In other words, any variation or modification may be possible provided that they attain their functions. For example, there is considered a case where a pair of openings and projections are formed sequentially, and thereby making their function in common.

Figure 8:
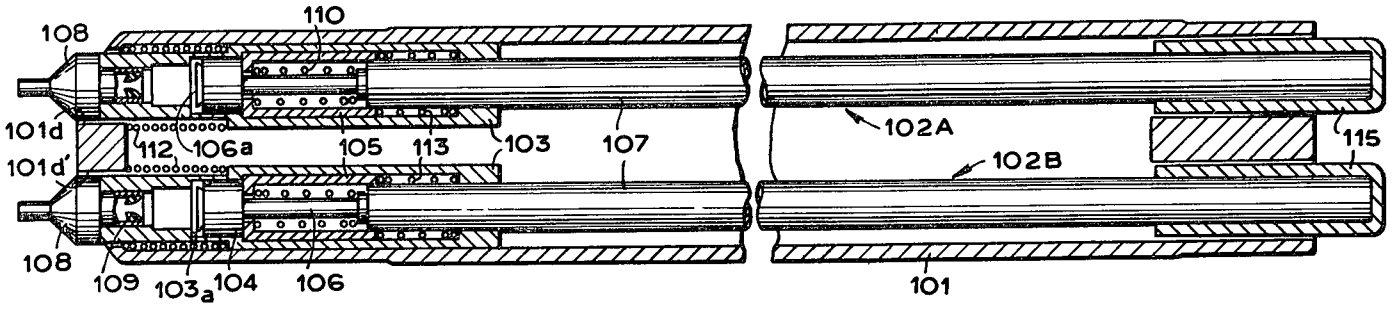
FIG. 8 is a longitudinal sectional view of the fourth embodiments of this invention.

FIG. 8 there is shown modified embodiment of the automatic pencil of FIG. 3. According to the automatic pencil of this embodiment, the tubular holder 1 has two openings 101*d*, 101*d* through which the caps 108, 108 are extruded alternatively or simultaneously. Of course there is no harm in writing even if both caps 108, 108 are simultaneously extruded because usually the automatic pencil is held with less than right angle between a paper and itself upon writing letters in addition to the fact that the caps 8, 8 are arranged with some space between each other.

As described in detail hereinabove, according to the present invention, there are great advantages such that, the entire lead rod holding mechanism makes forward and backward movements relative to the holder and when the lead rod holding mechanism is at the forwardly moved position, the writing instrument serves as a normal pencil and at the retracted position, the cap is almost completely enclosed in the holder whereby there is no risk of damaging the tip end of the cap having a small mechanical strength or of other objects being damaged by the thin tip end of the cap.

Further, as in the second embodiment of the present invention, if a writing instrument is provided with a plurality of lead rod holding mechanisms, the user can selectively use his desired lead. More specifically, the writing instrument of the invention can serve in a variety of use by setting different kind of leads together, such as, for instance, colored lead, hard lead, soft lead, and, further, core of ball-point pen or sign pen, in the plural number of lead rod holding mechanism.

Furthermore, the forward end of the clip is adapted to serve also for making engagement or disengagement of the lead rod holding mechanism, whereby there is no necessity of addition of an operation button therefor, thus resulting in simple construction, easy operation and favorable appearance of the writing instruments.

What is claimed is:

1. A writing instrument comprising:

(a) an outer tube to be held by a user;

(b) a lead rod holding means defining a space and having an inner tube which is coaxially inserted in said outer tube and movable in the axial direction relative to said outer tube;

(c) said inner tube having a lead chuck for chucking a lead rod inserted thereinto;

(d) an inner casing connected to said outer tube for guiding the lead rod chucked by said lead chuck;

(e) a ring having a bore through which said lead chuck projects and provided in said space in a manner to be movable in the axial direction;

(f) a movable member provided for retaining said ring in a forward position to cause said chucking portion to chuck the lead rod;

(g) a means for urging said lead rod holding means backward relative to said outer tube;

(h) an engaging means for holding said lead rod holding means at a position where said engaging means engages with an engaging portion formed on said outer tube;

(i) release means for releasing said engaging means from engagement with said engaging portion; and (j) pushing means provided on the rear end of said outer tube for pushing said lead rod holding means forward.

2. A writing instrument as claimed in claim 1 wherein said release means is made integral with said engaging means.

3. A writing instrument as claimed in claim 1 wherein said outer tube has a guide groove at the inner wall thereof for leading said engaging member backward when disengaged with said engaging portion.

4. The writing instrument of claim 1 wherein said release means is a push button provided for pressing said engaging means from engagement with said engaging portion.

5. The writing instrument of claim 1 wherein said pushing means is a button provided on the rear end of said outer tube for pushing said lead rod holding means forward.

6. The writing instrument of claim 1 wherein said release means is a clip attached to said outer tube for pressing said engaging means and releasing the engagement between said engaging means and said engaging portion.

7. The writing instrument of claim 1 wherein said engaging means has a lip, said engaging portion is an opening receiving said lip and said release means is a button disposed in the opening wherein the lip engages the opening and depression of the button releases the engagement between the lip and the opening.

8. The writing instrument of claim 1 wherein said engaging means has a lip and a button integral with the lip, said engaging portion is an opening receiving said lip and button and said release means is a clip disposed over the button, wherein the lip engages the opening and depression of the clip releases the engagement between the lip and the opening and results in engagement between the button and the opening.

9. A writing instrument comprising:

(a) a holder to be held by the user;

(b) first and second lead rod holding means each defining a space and having an inner tube which is axially inserted in said holder and movable in the axial direction relative to said holder;

(c) each said inner tube having a lead chuck for chucking a lead rod inserted thereinto;
(d) first and second inner casings for respectively guiding each of the lead rods chucked by each of said lead chucks;
(e) first and second rings each having a bore through which the respective lead chuck projects and each provided in each of the respective spaces in a manner to be movable in the axial direction;
(f) first and second movable members provided for retaining each of said rings in a forward position to cause each of said respective chucking portions to chuck each of the respective lead rods;
(g) means for urging each of said lead rod holding means backward relative to said holder;
(h) engaging means for holding each of said lead rod holding means at a position where said engaging means engages with an engaging portion formed on said holder;
(i) release means for releasing said engaging means from engagement with said engaging portion; and
(j) first and second push means provided on the rear end of said holder for selectively pushing each said lead rod holding means forward.

10. The writing instrument as claimed in claim 9 wherein each said release means is made integral with said engaging means.

11. The writing instrument of claim 9 wherein said release means is a clip attached to said outer tube for pressing said engaging means and releasing the engagement between said engaging means and said engaging portion.

12. The writing instrument of claim 9 wherein said holder has a single, axial forward opening through which said first and second lead rod holding means selectively project whenever said first and second push means are selectively pushed.

13. The writing instrument as claimed in claim 9 wherein a forward end of said tubular holding means has a plurality of openings through which each of said lead rods are projected respectively.

14. A writing instrument comprising:
(a) an outer tube to be held by a user;
(b) a first lead rod holding means defining a first space and having a first inner tube which is parallely coaxially inserted in said outer tube and movable in the axial direction relative to said outer tube;
(c) said first inner tube having a first lead chuck for chucking a first lead rod inserted thereinto;
(d) a first inner casing connected to said outer tube for guiding the first lead rod chucked by said first lead chuck;
(e) a first ring having a bore through which said first lead chuck projects and provided in said first space in a manner to be movable in the axial direction;
(f) a first movable member provided for retaining said first ring in a forward position to cause said first chucking portion to chuck the first lead rod;
(g) a first means for urging said first lead rod holding means backward relative to said outer tube;
(h) a first engaging means for holding said first lead rod holding means at a position where said first engaging means engages the engaging portion formed on said outer tube;
(i) first release means for releasing said first engaging means from the engagement with said first engaging portion;
(j) first pushing means provided on the rear end of said outer tube for pushing said first lead rod holding means forward;
(k) a second lead rod holding means defining a second space and having a second inner tube which is parallely coaxially inserted in said outer tube and movable in the axial direction relative to said outer tube;
(l) said second inner tube having a second lead chuck for chucking a second lead rod inserted thereinto;
(m) a second inner casing connected to said outer tube for guiding the second lead rod chucked by said second lead chuck;
(n) a second ring having a bore through which said second lead chuck projects and provided in said second space in a manner to be movable in the axial direction;
(o) a second movable member provided for retaining said second ring in a forward position to cause said second chucking portion to chuck the second lead rod;
(p) a second means for urging said second lead rod holding means backward relative to said outer tube;
(q) a second engaging means for holding said second lead rod holding means at a position where said second engaging means engages with the engaging portion formed by said outer tube;
(r) second release means for releasing said second engaging means from engagement with said second engaging portion; and
(s) second pushing means provided on the rear end of said outer tube for pushing said second lead rod holding means forward.

15. A writing instrument as claimed in claim 14 wherein a forward end of said outer tube has a plurality of openings through which each of said lead rods are projected respectively.

* * * * *